United States Patent [19]

Inoue et al.

[11] Patent Number: 4,681,836

[45] Date of Patent: Jul. 21, 1987

[54] SILVER HALIDE PHOTOGRAPHIC MATERIAL AND METHOD FOR FORMING HIGH CONTRAST NEGATIVE IMAGE USING THE SAME

[75] Inventors: Nobuaki Inoue; Yoshio Inagaki; Kimitaka Kameoka, all of Kanagawa, Japan

[73] Assignee: Fuji Photo Film Co., Ltd., Kanagawa, Japan

[21] Appl. No.: 933,258

[22] Filed: Nov. 20, 1986

Related U.S. Application Data

[63] Continuation of Ser. No. 660,580, Oct. 12, 1984, abandoned.

[30] Foreign Application Priority Data

Oct. 13, 1983 [JP] Japan ..... 58-191245

[51] Int. Cl.[4] ..... G03C 1/10; G03C 1/34

[52] U.S. Cl. ..... 430/434; 430/448; 430/436; 430/440; 430/441; 430/264; 430/265; 430/267; 430/599; 430/608; 430/601; 430/603; 430/600; 430/604; 430/605; 430/949

[58] Field of Search ..... 430/434, 448, 436, 440, 430/441, 264, 265, 267, 599, 608, 601, 603, 600, 604, 605, 949

[56] References Cited

U.S. PATENT DOCUMENTS

| | | | |
|---|---|---|---|
| 3,488,709 | 1/1970 | Sidebotham | 430/608 |
| 3,531,289 | 9/1970 | Wood | 430/605 |
| 4,335,199 | 6/1982 | Mickewich et al. | 430/949 |
| 4,346,167 | 8/1982 | Imatomi et al. | 430/608 |
| 4,452,882 | 6/1984 | Akimura et al. | 430/949 |
| 4,459,347 | 7/1984 | Parton et al. | 430/605 |

*Primary Examiner*—Won H. Louie

*Attorney, Agent, or Firm*—Sughrue, Mion, Zinn, Macpeak, and Seas

[57] ABSTRACT

A silver halide photographic material having at least one silver halide emulsion layer which contains silver halide grains containing from $1\times10^{-8}$ to $8\times10^{-6}$ mole of a rhodium salt per mole of silver, and containing in said emulsion layer or another hydrophilic colloidal layer a compound represented by formula (I)

$$R^1\text{-NHNH-G-}R^2 \qquad (I)$$

wherein $R^1$ represents an aliphatic group or an aromatic group; $R^2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted imino group; is exposed to imagewise pattern of light and then development-processed with a developer containing 0.15 mole/liter or more of sulfite ion and having a pH adjusted to from 9.5 to 12.3 to result in formation of high contrast negative image.

25 Claims, No Drawings

SILVER HALIDE PHOTOGRAPHIC MATERIAL AND METHOD FOR FORMING HIGH CONTRAST NEGATIVE IMAGE USING THE SAME

This is a continuation of application Ser. No. 660,580, filed Oct. 12, 1984, abandoned.

FIELD OF THE INVENTION

The present invention relates to a silver halide photographic material and a method for forming a high contrast negative image using it, and more particularly, to a silver halide photographic material to be employed for photomechanical processes and a method for forming a high contrast negative image using such a material.

BACKGROUND OF THE INVENTION

In photomechanical processes, a system for forming images which exhibits high contrast photographic characteristics (especially a gamma ($\gamma$) value of 10 or more) is required for satisfactory reproduction of continuous tone or line originals by means of dot image.

For this purpose, a general method has so far been employed of using a hydroquinone-containing developing solution in which the effective concentration of sulfite ion is extremely lowered (generally to 0.1 mole/-liter or less): this is a so-called infectious developer. However, the developing solution used in such a method is exceptionally unstable, and cannot stably withstand more than three days' storage because of the low sulfite ion concentration therein.

U.S. Pat. No. 2,419,975 describes that a high contrast negative image is obtained by addition of certain hydrazine compounds to a silver halide emulsion, and it requires the use of a developing solution having a high pH value such as 12.8 to provide a high contrast ($\gamma \geqq 10$) negative image by taking advantage of the hydrazine compounds described specifically in that patent specification. However, a strong alkali developer having a pH value near 13 is easily subject to air oxidation and unstable. Therefore, it cannot withstand long term storage and use. Although the keeping quality is, of course, improved by increasing the sulfite ion content, the addition of a large amount of sulfite is required for providing a sufficient improvement in the stability of such a high pH developer, and thereby not only is contamination of processing solutions caused, but also the serious problem of inhibiting the image from acquiring high contrast.

Under these circumstances, an image-forming system which does not have the above-described defects, provides a high contrast image, and ensures excellent keeping quality of processing solutions used therein has been needed.

For the purpose of meeting this need, a system for forming a high contrast negative image having a gamma of more than 10 wherein silver halide photographic materials having emulsions of the kind which form latent image predominantly at the surface of the grains, and in which particular acylhydrazine compounds which are not described in U.S. Pat. No. 2,419,975 as described above are incorporated, are processed with a stable developer having a pH of from 11.0 to 12.3, has been proposed in U.S. Pat. Nos. 4,224,401, 4,168,977, 4,166,742, 4,311,781, 4,272,606, 4,221,857, 4,243,739 and so on.

However, such an image-forming system still has a problem in that a high contrast image is difficult to produce when subjected to a so-called "rapid access processing" (that is, this terminology refers to exceptionally rapid photographic processing, and more specifically, to a processing wherein the total processing time from beginning of processing to the finish thereof at which drying of the processed film is completed is within the range of 90 to 120 seconds, of which the time allotted to development is from 15 to 60 seconds).

On the other hand, silver halide emulsions whose grains are formed in the presence of rhodium salts are described as high contrast ones, e.g., in British Pat. No. 775,197, U.S. Pat. No. 3,531,289, and so on. However, those rhodium salts provide only a minor contribution to the formation of the contrasty image (e.g., according to Example 1 of U.S. Pat. No. 3,531,289, addition of the rhodium salt only increased the contrast from 2.60 to 3.20), and therefore do not enable the formation of such a high contrast image as is required of silver halide photographic materials for photomechanical processes.

SUMMARY OF THE INVENTION

Therefore, a primary object of the present invention is to provide a silver halide photographic material which can exhibit as its photographic characteristic an extremely high contrast negative gradation, that is, gamma of more than 10 when processed with a stable developer, and to provide a method of forming an image using this photographic material.

Another object of the present invention is to provide a silver halide photographic material which can rapidly exhibit its photographic characteristic of extremely high contrast negative gradation, that is, gamma of more than 10, and to provide a rapid image-forming method which utilizes this material.

The above-described objects of the present invention are attained with a negative-working silver halide photographic material which has at least one silver halide emulsion layer containing silver halide grains containing from $1\times10^{-8}$ to $8\times10^{-6}$ mole of a rhodium salt per mole of silver, and containing in said emulsion layer or another hydrophilic colloidal layer a compound represented by formula (I)

$$R^1\text{—NHNH-G-}R^2 \qquad \text{(I)}$$

wherein $R^1$ represents an aliphatic group or an aromatic group; $R^2$ represents a hydrogen atom, a substituted or unsubstituted alkyl group, a substituted or unsubstituted aryl group, a substituted or unsubstituted alkoxy group, or a substituted or unsubstituted arlyloxy group; and G represents a carbonyl group, a sulfonyl group, a sulfoxy group, a phosphoryl group, or an N-substituted or unsubstituted imine group.

The invention also relates to a method for forming a high contrast negative image wherein the above-described photographic material is exposed to an image-wise pattern of light, and then development-processed with a developer containing 0.15 mole/liter or more of sulfite ion and having a pH adjusted to from 9.5 to 12.3.

DETAILED DESCRIPTION OF THE INVENTION

In formula (I), the aliphatic group represented by $R^1$ is preferably a group which contains from 1 to 30 carbon atoms, particularly a straight chain, branched or cyclic alkyl group containing from 4 to 20 carbon atoms. Herein, the branched alkyl group may be so cyclized as to form a saturated hetero ring containing one or more hetero atoms therein. In addition, such an alkyl group may have a substituent group such as an aryl group, an alkoxy group, a sulfonamido group, a carbonamido group, and so on. Specific examples of the alkyl group include a t-butyl group, an n-dodecyl group, a t-octyl group, a cyclohexyl group, a pyrrolidyl group, an imidazolyl group, a tetrahydrofuryl group, a morpholino group, and the like.

In formula (I), an aromatic group represented by $R^1$ is a monocyclic or dicyclic aryl group, or an unsaturated heterocyclyl group. The unsaturated heterocyclyl group may form a heteroaryl group by condensing with a monocylic or dicylclic aryl group.

Specific examples of such an aromatic group include a benzene ring, a naphthalene ring, a pyridine ring, a pyrimidine ring, an imidazole ring, a pyrazole ring, a quinoline ring, an isoquinoline ring, a benzimidazole ring, an indazole ring, a thiazole ring, a benzothiazole ring, and the like, preferably a benzene ring-containing ring.

A particularly preferred group as $R^1$ is an aryl group.

The aryl group or the unsaturated heterocyclyl group represented by $R^1$ may be substituted with another group. Suitable examples of such a substituent group include straight chain, branched or cyclic alkyl groups (preferably those containing from 1 to 20 carbon atoms, such as methyl, ethyl, isopropyl, n-dodecyl, etc.), aralkyl groups (preferably monocyclic or dicyclic groups whose alkyl moiety contains from 1 to 3 carbon atoms, such as a benzyl group), alkoxy groups (preferably those having 1 to 20 carbon atoms, such as methoxy, ethoxy, etc.), substituted amino groups (preferably those substituted by alkyl groups containing from 1 to 20 carbon atoms, such as dimethylamino, diethylamino, etc.), aliphatic acylamino groups (preferably those having an alkyl moiety containing 2 to 21 carbon atoms, such as acetylamino, heptylamino, etc.), aromatic acylamino groups (preferably those having a monocyclic or dicyclic aryl group, such as benzoylamino), and groups represented by $X—Y)_n$.

In the group represented by $X—Y)_n$, n represents 0 or 1; and Y represents a divalent linkage group, with examples including —CONH—, $—R^{11}—CONH—$, $—O—R^{11}—CONH—$, $—S—R^{11}—CONH—$, $—R^{11}—$, $—R^{11}—O—R^{12}—$, $—R^{11}—S—R^{12}—$, $—SO_2NH—$, $—R^{11}—SO_2NH—$, —NHCONH—, $—CH_2—CH=N—$, $—R^{11}—NH—$, $—R^{11}—O—R^{12}—CONH—$, $—NHCO—R^{11}—$, $—NHCO—R^{11}—CONH—$, $—R^{11}—R^{12}—$ and so on.

Therein, $R^{11}$ and $R^{12}$ may be the same as or different from each other, and they each represents a divalent saturated or unsaturated aliphatic group (e.g., ethylene, butenylene, 1-methylpropylene, etc.), or a divalent aromatic group (which may have a substituent like an amino group, e.g., phenylene, naphthylene, 5-amino-1,2-phenylene, etc.). In the case of $—R^{11}—R^{12}—$, however, $R^{11}$ and $R^{12}$ represent divalent groups different from each other.

Further, X represents a group having the bonding unit of

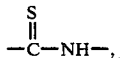

a group having the bonding unit of

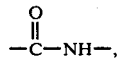

a group represented by

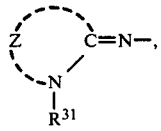

a heterocyclic ring residue, an aralkyl group (in the case of n=1), or an aryl group substituted by an alkyl group.

The term heterocyclic ring residue used above for X is intended to include residues of 5- or 6-membered rings containing at least one hetero atom, which may be condensed with an aromatic ring, especially a benzene ring. Preferred examples of such residues include monovalent residues of heterocyclic compounds (e.g., 1,2-benztriazol-5-yl, 5-tetrazolyl, indazol-3-yl, 1,3-benzimidazol-5-yl, hydroxytetraazainden-2- or -3-yl, and the like), monovalent groups of heterocyclic quaternary ammonium salts (e.g., N-ethylbenzthiazolinium-2-yl, N-sulfoethyl-benzthiazolinium-2-yl, N,N-dimethylbenzimidazolinium-2-yl, and the like), and monovalent groups of heterocyclic compounds having a mercapto group (e.g., 2-mercaptobenzothiazol-5- or -6-yl, 2-mercaptobenzoxazol-5- or -6-yl, and the like).

An aralkyl group represented by X includes monocyclic and dicyclic groups whose alkyl moiety contains from 1 to 3 carbon atoms, e.g., benzyl group.

An aryl group substituted by an alkyl group, which is represented by X, includes 2,4-di-t-amyl-1-phenyl group and the like.

Preferred examples of the group having the bonding unit of

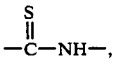

which is represented by X, include

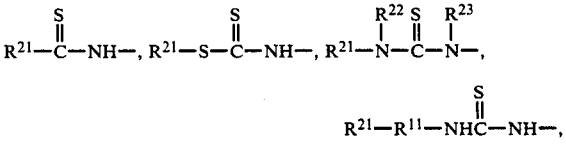

and so on. On the other hand, preferred examples of the group having the bonding unit of

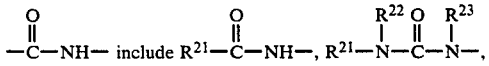

and so on.

Therein, $R^{21}$ represents an aliphatic group (e.g., an alkyl group, a cycloalkyl group, an alkenyl group, etc.), an aromatic group (e.g., a phenyl group, a naphthyl group, etc.) or a heterocyclic ring residue (e.g., a thiazolyl group, a benzothiazolyl group, an imidazolyl group, a thiazolinyl group, a pyridinyl group, a tetrazolyl group, etc.); $R^{22}$ represents a hydrogen atom, an aliphatic group set forth for $R^{21}$ or an aromatic group set forth for $R^{21}$; and $R^{23}$ represents a hydrogen atom or an aliphatic group set forth for $R^{21}$. $R^{11}$ has the same meaning as described above. However, at least either $R^{22}$ or $R^{23}$ must be a hydrogen atom. Further, $R^{21}$ and $R^{23}$ may combine with each other to form a ring. Examples of such a ring include

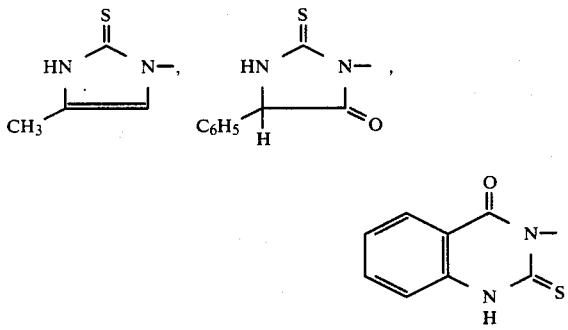

and so on.

The foregoing $R^{21}$ and $R^{22}$ may further be substituted by an alkoxy group, an alkoxycarbonyl group, an aryl group, an alkyl group, a dialkylamino group, an alkylthio group, a mercapto group, a hydroxy group, a halogen atom, a carboxyl group, a nitro group, a cyano group, a sulfonyl group, a carbamoyl group, and so on.

In the group of formula

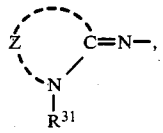

which is represented by X, Z represents non-metal atoms forming a 5- or 6-membered heterocyclic ring together with

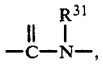

and specific examples of said heterocyclic ring include a thiazoline ring, a benzothiazoline ring, a naphthothiazoline ring, a thiazolidine ring, an oxazoline ring, a benzoxazoline ring, an oxazolidine ring, a selenazoline ring, a benzoselenazoline ring, an imidazoline ring, a benzimidazoline ring, a tetrazoline ring, a triazoline ring, a thiadiazoline ring, a 1,2-dihydropyridine ring, a 1,2-dihydroquinoline ring, a 1,2,3,4-tetrahydroquinoline ring, a perhydro-1,3-oxazine ring, a 2,4-benz[d]oxazine ring, a perhydro-1,3-thiazine ring, a 2,4-benz[d]thiazine ring, a uracil ring, and so on.

On the other hand, $R^{31}$ is a hydrogen atom, or a saturated or unsaturated aliphatic group (e.g., an alkyl group, an alkenyl group, an alkynyl group, etc.), and each of these groups may be further substituted by an alkoxy group, an alkylthio group, an acylamino group, an acyloxy group, a mercapto group, a sulfo group, a carboxyl group, a hydroxy group, a halogen atom, an amino group, and so on.

Of the above-described groups which can be represented by X, particularly preferred groups are a group containing the

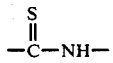

bonding unit, a group represented by

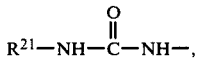

a group represented by

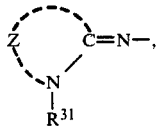

and an aryl group substituted by an alkyl group (particularly in the case that Y represents —O—$R^{11}$—CONH—).

Of groups represented by $R^2$ in formula (I), the aryl group, which may be substituted, is preferably a monocyclic or dicyclic group, such as a benzene ring or a naphthalene ring, and most preferably a benzene ring. This aryl group may be substituted by, e.g., a halogen atom, a cyano group, a carboxy group, a sulfo group, and so on. Examples of the aryl group represented by $R^2$ include a phenyl grouip, a 4-chlorophenyl group, a 4-bromophenyl group, a 3-chlorophenyl group, a 4-cyanophenyl group, a 4-carboxyphenyl group, a 4-sulfophenyl group, a 3,5-dichlorophenyl group, a 2,5-dichlorophenyl group, and the like.

Of groups represented by $R^2$ in formula (I), the alkyl group, which may be substituted, is preferably a group which contains from 1 to 4 carbon atoms, and may have a substituent such as a halogen atom, a cyano group, a carboxy group, a sulfo group, an alkoxy group, a phenyl group, and so on. As examples of the particularly preferred alkyl group, mention may be made of a methyl group, an ethyl group, an n-propyl group, an i-propyl group, a methoxyethyl group, a 2-carboxyethyl group, and the like.

Of groups represented by $R^2$ in formula (I), the alkoxy group, which may be substituted, is a group which contains from 1 to 8 carbon atoms, and may be substituted by a halogen atom, an aryl group, or so on. As examples of the alkoxy group, mention may be made of a methoxy group, an ethoxy group, an n-propoxy group, an isopropoxy group, a butoxy group, an isobutoxy group, a pentachlorobenzyloxy group, a hexyloxy group, and the like.

Of groups represented by $R^2$ in formula (I), the aryloxy group, which may be substituted, is preferably a monocyclic group. A substituent which the aryloxy group may have is a halogen atom and so on. Specific examples of the aryloxy group include a phenoxy group, a 4-chlorophenoxy group, and the like.

Groups preferred as $R^2$, when G represents a carbonyl group, are a hydrogen atom, a methyl group, a methoxy group, an ethoxy group, and a substituted or unsubstituted phenyl group. Of these groups, particularly preferred one is a hydrogen atom. When G represents a sulfonyl group, groups preferred as $R^2$ are a methyl group, an ethyl group, a phenyl group, and a 4-methylphenyl group, and particularly preferable is a methyl group. When G represents a phosphoryl group, groups preferred as $R^2$ are a methoxy group, an ethoxy group, a butoxy group, a phenoxy group and a phenyl group, particularly preferably a phenoxy group. When G represents a sulfoxy group, groups preferred as $R^2$ are a cyanobenzyl group, a methylthiobenzyl group, and the like. When G represents an N-substituted or unsubstituted imino group, groups preferred as $R^2$ are a methyl group, an ethyl group, and a substituted or unsubstituted phenyl group, particularly preferably a methyl group.

The most preferable group as G represents a carbonyl group.

Preferred compounds which are represented by formula (I) are described in U.S. Pat. Nos. 4,224,401, 4,243,739, 4,272,614 and 4,323,643, *Research Disclosure*, No. 17626 (Vol. 176, 1978), and so on. Of these compounds, particularly preferred compounds are described, for example, in U.S. Pat. No. 4,224,401.

Specific examples of compounds represented by formula (I) are illustrated below. However, the present invention should not be construed as being limited to the following examples.

I-1

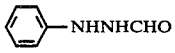

I-2

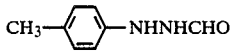

I-3

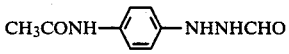

I-4

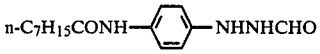

I-5

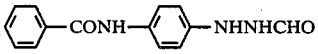

I-6

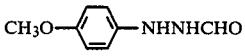

I-7

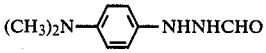

I-8

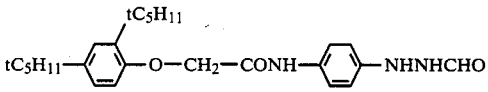

I-9

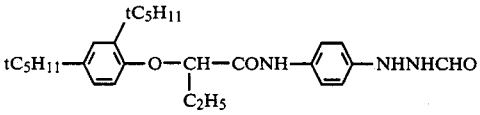

I-10

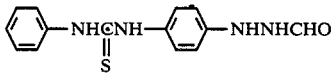

I-11

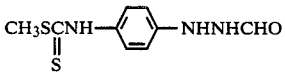

I-12

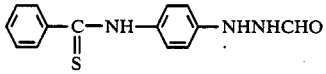

-continued

I-13

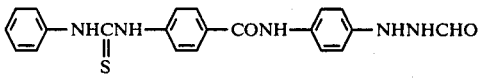

I-14

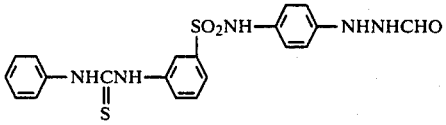

I-15

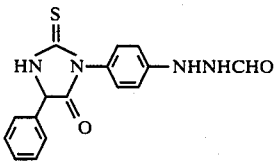

I-16

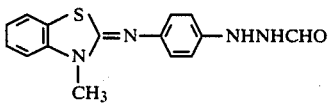

I-17

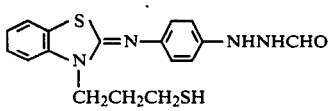

I-18

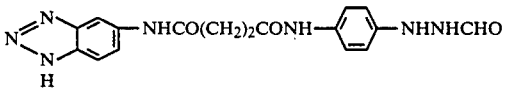

I-19

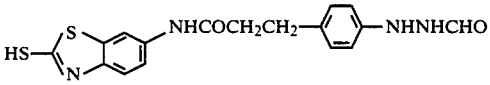

I-20

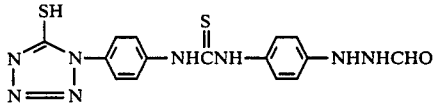

I-21

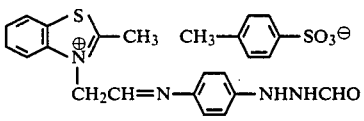

I-22

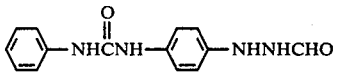

I-23

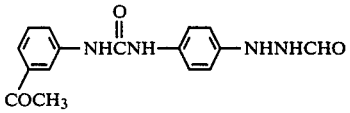

I-24

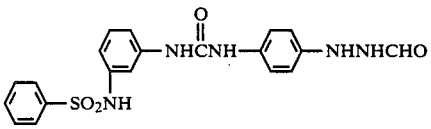

I-25

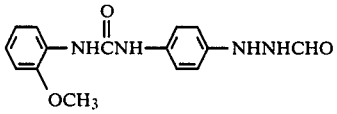

-continued
I-26
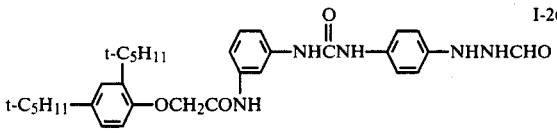
I-27
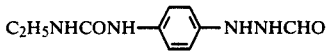
I-28
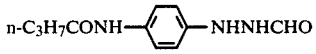
I-29
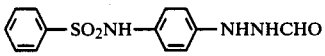
I-30
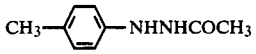
I-31
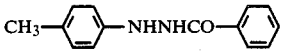
I-32
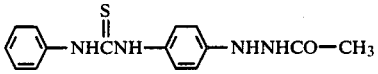
I-33
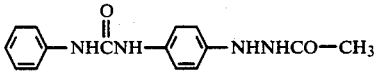
I-34
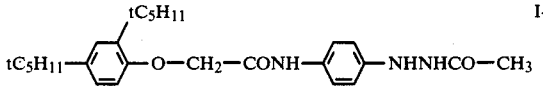
I-35
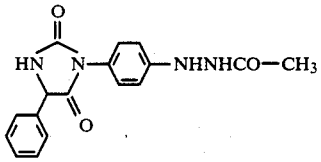
I-36
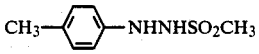
I-37
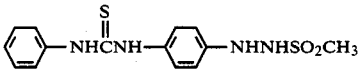
I-38
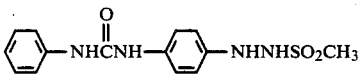
I-39
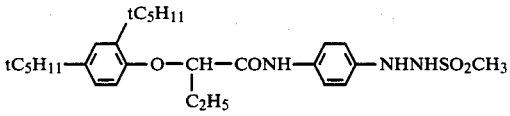
I-40
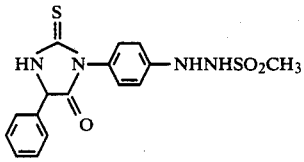
I-41
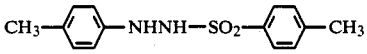
-continued
I-42
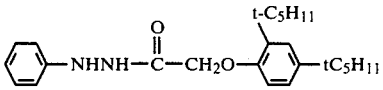
I-43
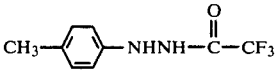
I-44
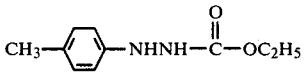
I-45
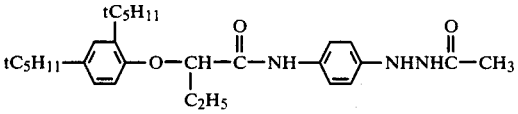
I-46
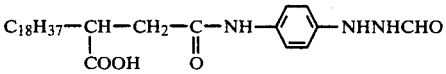
I-47
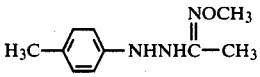
I-48
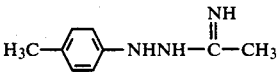
I-49
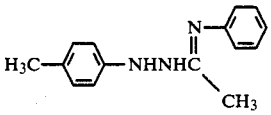
I-50
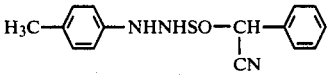
I-51
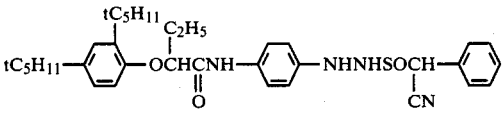
I-52
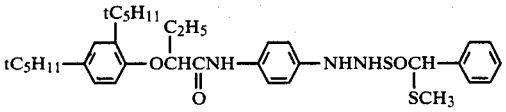
I-53
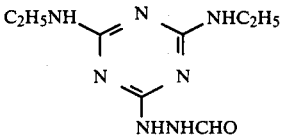
I-54
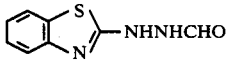
I-55
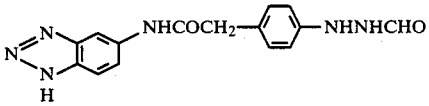
I-56
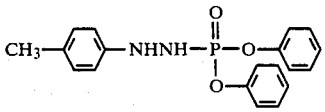

-continued

I-57

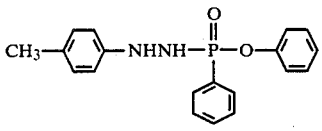

I-58

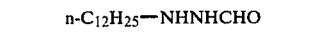

I-59

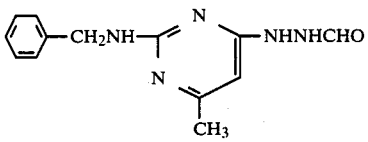

I-60

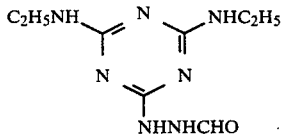

I-61

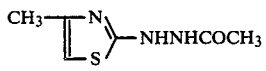

Methods for synthesizing these compounds are described in U.S. Pat. Nos. 4,168,977 and 4,224,401, and so on.

In the present invention, the compound represented by formula (I) can be incorporated in any one or more of hydrophilic colloidal layers which constitute the photographic material. It is desirable to incorporate the compound represented by formula (I) in a silver halide photographic emulsion layer, but the compound may be incorporated in any light-insensitive layers other than the photographic emulsion layer, for example, in a protective layer, an interlayer, a filter layer, an antihalation layer, and so on. Specifically, the compound is dissolved in an organic solvent miscible with water, such as alcohols (e.g., methanol and ethanol), esters (e.g., ethyl acetate), ketones (e.g., acetone), and so on, or in water, if soluble in water, and then added to a hydrophilic colloidal solution.

The compound may be added to the photographic emulsion at any stage of preparation from the beginning of chemical ripening to just before coating the emulsion. When added at the conclusion of chemical ripening (i.e., second ripening), more desirable results are obtained. It is particularly preferred to add the compound to a coating solution just before using.

It is desired that the compound is added in an optimum amount selected depending on the grain size and the halogen composition of the silver halide emulsion used, the method of chemical sensitization and the extent to be achieved thereby, the relation between the layer containing said compound and the photographic emulsion layers, the kind of the antifoggant used, and so on. Procedures for determining the optimum amount are well known and can easily be carried out by those skilled in the art. A suitable amount of the compound represented by formula (I) in the present invention ranges generally from $1\times10^{-6}$ mole to $5\times10^{-2}$ mole, and preferably from $1\times10^{-5}$ mole to $2\times10^{-2}$ mole, per mole of silver halide.

The silver halide present in the silver halide photographic material may have any halide composition, e.g., silver chloride, silver chlorobromide, silver iodobromide, silver iodobromochloride, and so on. However, the halide composition is desirably at least about 40 mole% chloride, and more preferably not less than 70 mole% chloride. Furthermore, the iodide content therein is desirably 5 mole% or less, and more preferably 1 mole% or less.

The silver halide grains containing a rhodium salt used in the present invention is silver halide grains prepared in the presence of a water-soluble rhodium salt. Examples of water-soluble rhodium salts which can be employed in the present invention include rhodium chloride, rhodium trichloride, rhodium ammonium chloride, and so on, and complex salts of rhodium may also be employed. These rhodium salts may be added at any stage of silver halide emulsion-making, provided that the first ripening (i.e., physical ripening) is not yet finished. In particular, they are desirably added during the period of grain-formation. A suitable addition amount of such a rhodium salt ranges from $1\times10^{-8}$ mole to $8\times10^{-6}$ mole, and more preferably from $1\times10^{-7}$ mole to $5\times10^{-6}$ mole, per mole of silver.

When a rhodium salt is added to a silver halide emulsion, high contrast is imparted to the emulsion, but at the same time, a decrease in sensitivity is caused in the emulsion. However, the emulsion of the present invention has the characteristic that the lowering of the sensitivity due to addition of a rhodium salt is recovered by the addition of the compound represented by formula (I), and, at the same time, extremely high contrast is provided.

Suitable methods for reacting a water-soluble silver salt with a water-soluble halide include, e.g., a single jet method, a double jet method, or a combination thereof.

Also, a method in which silver halide grains are produced in the presence of excess silver ion (the so-called reversal mixing method) can be employed. In addition, the so-called controlled double jet method, wherein the pAg of the liquid phase in which silver halide grains are to be precipitated is maintained constant, can be employed. According to this method, a silver halide emulsion having a regular crystal form and a nearly uniform grain size can be obtained.

The grain-formation is carried out preferably under an acidic condition. As a result of our experiment, it has now been found that the effect of the present invention is lessened under a neutral or an alkaline condition. A preferred pH range for the grain-formation is 6 or less, and more preferably 5 or less.

The silver halide grains in the photographic emulsion to be employed in the present invention can have a comparatively broad grain size distribution, but preferably have a narrow grain size distribution. In particular, when sizes of grains accounting for 90% of all silver halide grains in regard to weight or number are within the range of ±40% of the mean grain size (an emulsion having such a grain size distribution is generally called a "monodisperse" emulsion), a desirable result is obtained.

In the present invention, fine grains (having an average size of, e.g., 0.7 μm or less, and preferably 0.4 μm or less) are preferred.

The silver halide grains in the photographic emulsion of this invention may have a regular crystal form, such as that of a cube or an octahedron; an irregular crystal form, such as that of a sphere, a plate or so on; or a composite form thereof. A mixture of various crystal forms of silver halide grains may also be present.

The interior and the surface of the silver halide grains may differ, or the silver halide grains may be uniform throughout.

Silver halide used in the present invention is one capable of providing a negative image. Particularly preferred silver halide is a substantially surface latent image-type silver halide as defined in U.S. Pat. No. 4,224,401.

Further, two or more of silver halide emulsions prepared separately may be used together in a form of mixture.

In a process of producing silver halide grains or allowing the produced silver halide grains to ripen physically, cadmium salts, zinc salts, lead salts, thallium salts, iridium salts or complexes, iron salts or complexes, and/or the like may be present.

As for the binder or the protective colloid of the photographic emulsion, it is advantageous to use gelatin. Of course, hydrophilic colloids other than gelatin may also be used. For example, proteins such as gelatin derivatives, polymers prepared by grafting other high polymers on gelatin, albumin, casein, etc.; sugar derivatives such as cellulose derivatives (e.g., hydroxyethyl cellulose, carboxymethyl cellulose, cellulose sulfates, etc.), sodium alginate, starch derivatives and so on; and various kinds of synthetic hydrophilic high polymers, such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, and like copolymers can be employed.

Gelatin which can be employed in the present invention includes not only lime-processed gelatin, but also acid-processed gelatin, and further may include hydrolysis products of gelatin and enzymatic degradation products of gelatin. Suitable gelatin derivatives which may be employed include products obtained by reacting gelatin with various kinds of compounds, such as acid halides, acid anhydrides, isocyanates, bromoacetic acid, alkane sulfones, vinylsulfonamides, maleinimide compounds, polyalkylene oxides, epoxy compounds, and so on.

Removal of the soluble salts from the silver halide emulsion is, in general, carried out after the formation of silver halide grains or after physical ripening. The removal can be effected using the noodle washing method, which comprises gelling the gelatin, or using a precipitation process (wherein flocculation is caused in the emulsion) taking advantage of a precipitating agent such as a polyvalent anion-containing inorganic salt (e.g., sodium sulfate), an anionic surface active agent or an anionic polymer (e.g., polystyrenesulfonic acid), or a gelatin derivative (e.g., an aliphatic acylated gelatin, an aromatic acylated gelatin, an aromatic carbamoylated gelatin or the like). The removal of soluble salts from the silver halide emulsion may be omitted.

The silver halide emulsion of the present invention may not be a chemically sensitized. However, it is preferred that the emulsion of the present invention is chemically sensitized. Chemical sensitization of the silver halide emulsion can be carried out using known processes, such as sulfur sensitization, reduction sensitization and noble metal sensitization, independently or in combination with two or more thereof. Such sensitization processes are described in P. Glafkides, *Chimie et Physique Photographique,* Paul Montel, Paris (1957); V. L. Zelikman et al., *Making and Coating Photographic Emulsion,* The Focal Press, London (1964); and H. Frieser, *Die Grundlagen der Photographischen Prozesse mit Silberhalogeniden,* Akademische Verlagsgesellschaft (1968).

The gold sensitization process is representative of the noble metal sensitization processes, and gold compounds, predominantly gold complexes, are employed therein. Complexes of noble metals other than gold (such as platinum complex, palladium complex and iridium complex) may also be present. Specific examples of these metal complexes are described in U.S. Pat. No. 2,448,060, British Patent No. 618,061, and so on.

Sulfur sensitizers which can be used include not only sulfur compounds contained in gelatin but also various kinds of sulfur compounds such as thiosulfates, thioureas, thiazoles, rhodanines, and so on. Specific examples of these sulfur compounds are described in U.S. Pat. Nos. 1,574,944, 2,278,947, 2,410,689, 2,728,668, 3,501,313, and 3,656,955.

Reduction sensitizers which can be used include stannous salts, amines, formamidinesulfinic acid, silane compounds, and so on, and specific examples thereof are described in U.S. Pat. Nos. 2,487,850, 2,518,698, 2,983,609, 2,983,610, and 2,694,637.

The photographic material of the present invention can contain a wide variety of compounds for purposes of preventing fogging or stabilizing photographic functions during preparation, storage or photographic processing. More specifically, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds like oxazolinethione; azaindenes, such as triazaindenes, tetraazaindenes (particularly 4-hydroxysubstituted-(1,3,3a,7)tetraazaindenes), pentaazaindenes, etc.; and a large number of compounds known as antifoggants or stabilizers, such as benzenethiosulfonic acid, benzenesulfinic acid, benzenesulfonic acid amide, and the like. Of these compounds, particularly preferred compounds are benzotriazoles (e.g., 5-methylbenzotriazole) and nitroindazoles (e.g., 5-nitroindazole). Also, these compounds may be contained in a processing solution.

The photographic material to be employed in the present invention can contain sensitizing dyes described in Japanese Patent Application (OPI) No. 52050/80 (the term "OPI" as used herein refers to a "published unexamined Japanese patent application") (e.g., cyanine dyes, merocyanine dyes, etc., which may be used individually or in combinations of two or more thereof), supersensitizers (e.g., aminostilbene compounds, aromatic organic acid-formaldehyde condensates, cadmium salts, azaindene compounds, etc.), water-soluble dyes (as a filter dye or for the purpose of prevention of irradiation, with specific examples including oxonol dyes, hemioxonol dyes, merocyanine dyes, and so on), hardeners (e.g., chromium salts, aldehydes, N-methylol compounds, dioxane derivatives, active vinyl compounds, active halogen-containing compounds, etc.), surface active agents (e.g., known various kinds of nonionic, anionic, cationic and amphoteric surface active agents, particularly usefully polyoxyalkylenes described in Japanese Patent Application (OPI) No. 37732/79), and so on.

Polyalkylene oxides or their derivatives which can be used to advantage in the present invention have a molecular weight of at least 600, and said polyalkylene oxides or derivatives thereof may be incorporated in the silver halide photographic material, or may be added to a developing solution.

The polyalkylene oxide compounds which can be used in the present invention include condensates of polyalkylene oxides constituted by at least 10 units of alkylene oxide containing from 2 to 4 carbon atoms, such as ethylene oxide, propylene-1,2-oxide, butylene-1,2-oxide, etc., preferably ethylene oxide, and compounds containing at least one active hydrogen, such as water, aliphatic alcohols, aromatic alcohols, fatty acids, organic amines, hexitol derivatives, etc.; block copolymers prepared from two or more different kinds of polyalkylene oxides; and so on.

More specifically, suitable examples of such polyalkylene oxide compounds include polyalkylene glycols, polyalkylene glycol alkyl ethers, polyalkylene glycol aryl ethers, polyalkylene glycol alkyl aryl ethers, polyalkylene glycol esters, polyalkylene glycol fatty acid amides, polyalkylene glycol amines, block copolymers of polyalkylene glycols, grafted polymers of polyalkylene glycols, and so on.

The number of polyalkylene oxide chain in one molecule is not limited to one, but two or more of polyalkylene oxide chains may be contained in one molecule. In the latter case, individual polyalkylene oxide chains may consist of less than 10 alkylene oxide units, but the sum total of the alkylene oxide units in the molecule must be at least 10. When one molecule has two or more polyalkylene oxide chains, the chains may differ in constituent alkylene oxide unit form one another, for example, if one of the chains consists of ethylene oxide units, another may consist of propylene oxide units or so on. Suitable polyalkylene oxide compounds which can be employed in the present invention are those containing from 14 to 100 alkylene oxide units.

The photographic material to be employed in the present invention can contain a dispersion of water-insoluble or slightly soluble synthetic polymer for the purpose of improvement in dimensional stability and so on. For example, homopolymers or copolymers prepared from an alkyl(meth)acrylate, an alkoxyalkyl(meth)acrylate, glycidyl(meth)acrylate, (meth)acrylamide, a vinyl ester (e.g., vinyl acetate), acrylonitrile, an olefin, styrene, and so on, and copolymers containing as monomer units combinations of some of the above-described monomers with acrylic acid, methacrylic acid, an $\alpha,\beta$-unsaturated dicarboxylic acid, hydroxyalkyl(meth)acrylate, a sulfoalkyl(meth)acrylate, styrenesulfonic acid or so on can be employed. More specifically, those described in U.S. Pat. Nos. 2,376,005, 2,739,137, 2,853,457, 3,062,674, 3,411,911, 3,488,708, 3,525,620, 3,607,290, 3,635,715 and 3,645,740, and British Patent Nos. 1,186,699 and 1,307,373 can be employed. The high contrast emulsion as to be provided in the present invention is well suited for reproduction of line originals, and for this purpose the dimensional stability is of importance. Therefore, it is preferred to incorporate such a polymer dispersion as described above in the photographic emulsion of the present invention.

In the method of the present invention, a conventional infectious developer (lith developer) and a highly alkaline developer (pH near 13), which is described in U.S. Pat. No. 2,419,975 are not required for acquisition of high contrast negative gradation as a photographic characteristic using the imagewise exposed silver halide photographic material of the present invention, but a stable developer can be used for this purpose.

That is, according to the method of the present invention, a developer which contains a sufficient amount of sulfite ion (particularly, 0.15 mole/liter or more of sulfite ion) as a preservative can be employed, and a satisfactory high contrast photographic characteristics can be achieved by using a developer adjusted to a pH of 9.5 or higher, and preferably to a pH of from 10.5 to 12.3.

Further according to the method of the present invention, high contrast negative gradation corresponding to gamma of 10 or above can be acquired by carrying out a rapid processing (rapid access processing) using a stable developer as described above and taking 15 to 60 seconds as a development time. Therefore, the present invention is of great advantage in this point also.

The present invention is not particularly restricted as to the developing agent to be used. Suitable developing agents include 3-pyrazolidones (e.g, 1-phenyl-3-pyrazolidone, 4,4-dimethyl-1-phenyl-3-pyrazolidone), aminophenols (e.g., N-methyl-p-aminophenol), 1-phenyl-3-pyrazolines, dihydroxybenzenes (e.g., hydroquinone) and so on, and these can be used alone or in combinations.

The photographic material of the present invention is suited particularly for the processing with a developer containing dihydroxybenzenes as a main developing agent and 3-pyrazolidones as an auxiliary developing agent. The concentration of dihydroxybenzenes in this developer is controlled preferably to the range of from 0.05 to 0.5 mole/liter, and the range of 3-pyrazolidones is controlled preferably to 0.06 mole/liter or less.

In addition to these developing agent, the developer contains generally known preservatives, alkali agent, pH buffering agent, antifoggant (particularly preferably nitroindazoles, benzotriazoles or the like) and so on. Further, it may optionally contain a dissolving aid, a color toning agent, a development accelerator, a surface active agent (particularly preferably the foregoing polyalkylene glycols), a defoaming agent, a water softener, a hardener, a viscosity imparting agent and an inhibitor for silver stain due to transfer from other films (e.g., 2-mercaptobenzimidazolesulfonic acids, etc.).

A fixing solution which can be used in one which has a generally used composition. Suitable fixing agents include not only thiosulfates and thiocyanates, but also organic sulfur compounds which have so far been known to be effective as a fixing agent. The fixing solution may contain a water-soluble aluminum salt as a hardener.

A processing temperature in the method of the present invention is selected usually from the range of 18° C. to 50° C.

It is preferred to use an automatic developing machine for photographic processing, and according to the method of the present invention, the photographic characteristics of a satisfactory high contrast negative gradation can be acquired even when a total processing time from entry of the photographic material in an automatic developing machine until exit there from the machine is set at from 90 seconds to 120 seconds.

The combined use of a silver halide emulsion containing a prescribed amount of rhodium salt and the compound represented by formula (I) enables the photographic material of the present invention to acquire a remarkably high contrast characteristics which is effective in reproducing halftone images and line drawings. In addition, the photographic material of the present invention makes it feasible to rapidly acquire very high contrast characteristics even when processed with a developing solution to which a sufficient amount of sodium sulfite is added, and the method of the present invention has an excellent advantage in that long term use of the developer becomes feasible due to its high stability.

The present inventioon is illustrated in greater detail by reference to the following examples.

EXAMPLE 1

The grain formation was carried out in the presence of rhodium ammonium chloride, and five kinds of monodisperse silver chlorobromide Emulsions, A to E, which differed in addition amount of the rhodium salt and content of silver chloride, as shown in Table 1, were prepared (having a mean grain size of 0.3 μm).

Each of these emulsions was washed with water in a conventional manner to remove soluble salts therefrom, and then sensitized chemically by addition of sodium thiosulfate and potassium chloroaurate.

The resulting silver chlorobromide emulsion was divided into three portions, and thereto, Compound I-8 was added in amounts described in Table 1, respectively. Thereafter, to each portion was added 3-ethyl-5-[2-(3-ethyl-2(3H)-thiazolinidene-ethylidene]rhodanine as a sensitizing dye, and further 5-methylbenzotriazole, 4-hydroxy-6-methyl-1,3,3a,7-tetraazaindene, a polyethylacrylate dispersion, and sodium salt of 2-hydroxy-4,6-dichloro-1,3,5-triazine. The thus prepared composition was coated on a cellulose triacetate film at a dry coverage of 4 g silver per square meter.

These films were exposed to light using a 150-line magenta contact screen through an exposure wedge for sensitometry, and then developed with a developing solution having the following composition at 38° C. for 20 seconds, followed by stopping, fixation, washing and drying steps, in that order.

Developing Solution

Hydroquinone: 40.0 g
4,4-Dimethyl-1-phenyl-3-pyrazolidone: 0.4 g
Anhydrous Sodium Sulfite: 75g
Sodium Hydrogencarbonate: 7.0 g
Disodium Ethylenediaminetetraacetate: 1.0 g
Potassium Bromide: 6.0 g
5-Methylbenzotriazole: 0.6 g
Water to make: 1 liter
Potassium hydroxide to adjust pH to: 11.5

The results obtained are shown in Table 1.

TABLE 1

| Sample No. | Emulsion Kind | Emulsion Halide Composition | Emulsion Rh Amount (mol/mol Ag) | Compound I-8 Amount Added (mol/mol Ag) | Gamma | Fog | Dot* Quality |
|---|---|---|---|---|---|---|---|
| 1 | A | AgClBr | $2.7 \times 10^{-7}$ | 0 | 6.5 | 0.04 | 1 |
| 2 | | (Cl = 90 mol %) | | $2.2 \times 10^{-3}$ | 15 | 0.04 | 4 |
| 3 | | | | $4.5 \times 10^{-3}$ | 18 | 0.04 | 5 |
| 4 | B | AgClBr | $2.7 \times 10^{-7}$ | 0 | 6.5 | 0.04 | 1 |
| 5 | | (Cl = 70 mol %) | | $2.2 \times 10^{-3}$ | 16 | 0.04 | 4 |
| 6 | | | | $4.5 \times 10^{-3}$ | 18 | 0.04 | 5 |
| 7 | C | Same as above | $5 \times 10^{-6}$ | 0 | 7.0 | 0.04 | 1 |
| 8 | | | | $2.2 \times 10^{-3}$ | 14 | 0.04 | 4 |
| 9 | | | | $4.5 \times 10^{-3}$ | 17 | 0.04 | 5 |
| 10 | D | Same as above | 0 | 0 | 4.0 | 0.04 | 1 |
| 11 | | | | $2.2 \times 10^{-3}$ | 8.0 | 0.07 | 1 |
| 12 | E | Same as above | $1 \times 10^{-5}$ | 0 | 5.0 | 0.04 | 1 |
| 13 | | | | $4.5 \times 10^{-3}$ | 5.5 | 0.04 | 1 |
| 14 | | | | $2.2 \times 10^{-2}$ | 6.0 | 0.04 | 1 |

*Dot quality evaluated visually in five grades, wherein "5" is the best, and "1" is the worst. Photographic materials having dot qualities "5" and "4" are practical for use as halftone masters for photographic arts, Those having a dot quality "3", though coarse, can be used practically when high quality is not necessary, and those having dot qualities "2" and "1" are incapable of being used practically.

No. 10 in Table 1 was a blank sample. As can be clearly seen from the comparison of Sample No. 10 and Sample Nos. 1, 4 and 7, the single use of the rhodium salt brought about a very slight increase in gamma. Further, from the comparison of No. 10 with No. 11, it has turned out that when rapid processing as described in the present invention is carried out, only a small increase in gamma is obtained by single use of the compound having the general formula (I).

In contrast to these results, as can be seen from the data of Sample Nos. 2, 3, 5, 6, 8 and 9, it is evident that only when an emulsion containing silver halide grains prepared in the presence of a rhodium salt and the compound represented by formula (I) in the present invention are used in combination, gamma of more than 10 is achieved even by rapid photographic processing, and therefore dots of high quality can be obtained.

On the other hand, when the rhodium salt was used in amounts increased beyond the range specified by the present invention, an increase in gamma was not able to be brought about even if an addition amount of the compound of formula (I) was increased, as can be shown by the results of Sample Nos. 13 and 14.

Accordingly, it has proved that upon rapid processing, the photographic characteristic of negative gradation having gamma of more than 10 can be effected only by the combination of the present invention.

In addition, though the addition of the rhodium salt caused some extent of desensitization, sensitivity equivalent to or higher than that of Sample No. 10 was able to be acquired by the addition of the compound of the present invention.

EXAMPLE 2

The results shown in Table 2 were obtained by using Emulsion A and Emulsion B prepared in Example 1 and carrying out the same photographic processing as employed in Example 1, except that kinds and addition amounts of the compound represented by formula (I) were changed as shown in Table 2.

TABLE 2

| Sample No. | Emulsion | Compound of Formula (I) Kind | Amount Added (mol/mol Ag) | Gamma | Fog | Dot Quality |
|---|---|---|---|---|---|---|
| 1 | A | — | 0 | 6.5 | 0.04 | 1 |
| 15 | | I-1 | $2.2 \times 10^{-3}$ | >20 | 0.04 | 5 |
| 16 | | " | $4.4 \times 10^{-3}$ | >20 | 0.04 | 5 |
| 17 | | I-8 | $4.4 \times 10^{-3}$ | 18 | 0.04 | 5 |
| 4 | B | — | 0 | 6.5 | 0.04 | 1 |
| 18 | | I-1 | $2.2 \times 10^{-3}$ | >20 | 0.04 | 5 |
| 19 | | " | $4.4 \times 10^{-3}$ | >20 | 0.04 | 5 |
| 20 | | I-8 | $4.4 \times 10^{-3}$ | 18 | 0.04 | 5 |

It is further evident from the results in Table 2 that gamma of more than 10 and excellent dot quality are obtained by the combination of the present invention.

EXAMPLE 3

The grain formation was carried out in the presence of rhodium ammonium chloride, and two kinds of monodisperse silver iodobromide Emulsions F and G (mean grain size: 0.3 μm) were prepared making such changes as are shown in Table 3. After subjected to water washing and chemical sensitization treatments in the same manner as in Example 1, these emulsions were each divided into four portions. To each portion, the compound of formula (I) of the present invention was added, in such kind and amount as shown in Table 3, and then the same additives as used in Example 1 were added. The thus prepared compositions were each coated on a cellulose triacetate film at a dry coverage of 4 g silver per square meter to make a sample.

Each sample was exposed to light and processed in the same manner as employed in Example 1. The results obtained are shown in Table 3.

TABLE 3

| Sample No. | Emulsion Kind | Halide Composition | Rh Amount (mol/mol Ag) | Compound of Formula (I) Kind | Amount Added (mol/mol Ag) | Gamma | Fog | Dot Quality |
|---|---|---|---|---|---|---|---|---|
| 21 | F | AgBrI | $2 \times 10^{-7}$ | — | 0 | 4.5 | 0.04 | 1 |
| 22 | | (I = 0.1 mol %) | | I-1 | $2.2 \times 10^{-3}$ | 10 | 0.04 | 3 |
| 23 | | | | " | $4.4 \times 10^{-3}$ | 16.5 | 0.04 | 4 |
| 24 | | | | I-8 | $4.4 \times 10^{-3}$ | 16.5 | 0.04 | 3 |
| 25 | G | AgBrI | 0 | — | 0 | 3.5 | 0.04 | 1 |
| 26 | | (I = 0.1 mol %) | | I-1 | $2.2 \times 10^{-3}$ | 7.5 | 0.04 | 2 |
| 27 | | | | " | $4.4 \times 10^{-3}$ | 12 | 0.04 | 2 |
| 28 | | | | I-8 | $4.4 \times 10^{-3}$ | 6.5 | 0.04 | 2 |

As can be seen clearly from the results in Table 3, the combination of the present invention can also produce its effect on a silver iodobromide emulsion. However, in comparison with the effect on the silver chlorobromide emulsion, the combination of the present invention can exhibit more excellent effects on the silver chlorobromide emulsions than on the silver iodobromide emulsion.

While the invention has been described in detail and with reference to specific embodiments thereof, it will be apparent to one skilled in the art that various changes and modifications can be made therein without departing from the spirit and scope thereof.

What is claimed is:

1. A negative-working silver halide photographic material which has at least one silver halide emulsion layer containing silver halide grains containing from $1 \times 10^{-8}$ to $8 \times 10^{-6}$ mole of a rhodium salt per mole of silver, and containing in said emulsion layer or another hydrophilic colloidal layer a compound represented by formula (I)

$$R^1\text{—NHNH—G—}R^2 \qquad \text{(I)}$$

wherein $R^1$ represents an aliphatic group or an aromatic group; $R^2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted imino group.

2. A negative-working silver halide photographic material as in claim 1, wherein the aliphatic groups for $R^1$ has from 1 to 30 carbon atoms.

3. A negative-working silver halide photographic material as in claim 1, wherein the aromatic group for $R^1$ is a monocyclic or dicyclic aryl group.

4. A negative-working silver halide photographic material as in claim 1, wherein the aromatic group for $R^1$ is an unsaturated heterocyclic group.

5. A negative-working silver halide photographic material as in claim 3, wherein the aryl group is a substituted or unsubstituted aryl group.

6. A negative-working silver halide photographic material as in claim 5, wherein the substituent for the substituted aryl group is a straight chain, branched chain or cyclic alkyl group, an aralkyl group, an alkoxy group, a substituted amino group, an aliphatic acylamino group, an aromatic acylamino group, or a group of $X\text{—}Y)_n$; in which n is 0 or 1, Y is a divalent linkage group, and X is a group having a bonding unit of $$-\overset{\overset{\displaystyle S}{\|}}{C}\text{—NH—},$$

a group having a bonding unit of $$-\overset{\overset{\displaystyle O}{\|}}{C}\text{—NH—},$$

a group represented by

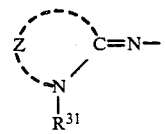

(wherein Z is non-metal atoms forming a 5- or 6-membered heterocyclic ring together with $$-\overset{\overset{\displaystyle R^{31}}{|}}{\underset{\underset{\displaystyle O}{\|}}{C}}-N-,$$

and $R^{31}$ is a hydrogen atom or a saturated or unsaturated aliphatic group), a heterocyclic ring residue, an aralkyl group (in the case of n=1), or an aryl group substituted by an alkyl group.

7. A negative-working silver halide photographic material as in claim 6, wherein Y is —CONH—, —$R^{11}$—CONH—, —O—$R^{11}$—CONH—, —S—$R^{11}$—CONH—, —$R^{11}$—, —$R^{11}$—O—$R^{12}$—, —$R^{11}$—S—$R^{12}$—, —$SO_2$NH—, —$R^{11}$—$SO_2$NH—, —NHCONH—, —$CH_2$—CH=N—, —$R^{11}$—NH—, —$R^{11}$—O—$R^{12}$—CONH—, —NHCO—$R^{11}$—, —NHCO—$R^{11}$—CONH—, or —$R^{11}$—$R^{12}$—, wherein $R^{11}$ and $R^{12}$ each represents a divalent saturated or unsaturated aliphatic group, or a divalent aromatic group, in proviso that when Y is —$R^{11}$—$R^{12}$—, $R^{11}$ and $R^{12}$ represent divalent groups different from each other.

8. A negative-working silver halide photographic material as in claim 1, wherein the aryl group for $R^2$ is a monocyclic or dicyclic aryl group.

9. A negative-working silver halide photographic material as in claim 1, wherein the alkyl group for $R^2$ has from 1 to 4 carbon atoms.

10. A negative-working silver halide photographic material as in claim 1, wherein the alkoxy group for $R^2$ has from 1 to 8 carbon atoms.

11. A negative-working silver halide photographic material as in claim 1, wherein the aryloxy group for $R^2$ is a monocyclic aryloxy group.

12. A negative-working silver halide photographic material as in claim 1, wherein $R^2$ represents a hydrogen atom, a methyl group, a methoxy group, an ethoxy group, or a substituted or unsubstituted phenyl group, and G represents a carbonyl group.

13. A negative-working silver halide photographic material as in claim 1, wherein $R^2$ represents a methyl group, an ethyl group, a phenyl group, or a 4-methylphenyl group, and G represents a sulfonyl group.

14. A negative-working silver halide photographic material as in claim 1, wherein $R^2$ represents a methoxy group, an ethoxy group, a butoxy group, a phenoxy group, or a phenyl group, and G represents a phosphoryl group.

15. A negative-working silver halide photographic material as in claim 1, wherein $R^2$ represents a cyanobenzyl group or a methylthiobenzyl group, and G represents a sulfoxy group.

16. A negative-working silver halide photographic material as in claim 1, wherein $R^2$ represents a methyl group, an ethyl group, or a substituted or unsubstituted phenyl group, and G represents an N-substituted or unsubstituted imino group.

17. A negative-working silver halide photographic material as in claim 1, wherein the content of the compound of formula (I) ranges from $1\times10^{-6}$ mole to $5\times10^{-2}$ mole per mole of silver halide in the silver halide emulsion layer.

18. A negative-working silver halide photographic material as in claim 19, wherein the content of the compound of formula (I) ranges from $1\times10^{-5}$ mole to $2\times10^{-2}$ mole per mole of a silver halide in the silver halide emulsion layer.

19. A negative-working silver halide photographic material as in claim 1, wherein the silver halide emulsion layer contains silver halide grains prepared in the presence of from $1\times10^{-7}$ to $5\times10^{-6}$ mole of rhodium salt per mole of silver.

20. A negative-working silver halide photographic material as in claim 1, wherein the halide of said silver halide grains is at least about 40 mole% chloride.

21. A negative-working silver halide photographic material as in claim 1, wherein the halide of said silver halide grains is at least about 70 mole% chloride.

22. A method for forming a high contrast negative image in which a silver halide photographic material having at least one silver halide emulsion layer containing silver halide grain containing from $1\times10^{-8}$ to $8\times10^{-6}$ mole of a rhodium salt per mole of silver, and containing in said emulsion layer or another hydrophilic colloidal layer a compound represented by formula (I)

$$R^1—NHNH—G—R^2 \qquad (I)$$

wherein $R^1$ represents an aliphatic group or an aromatic group; $R^2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted imino group; is exposed to an imagewise pattern of light and then development-processed with a developer containing 0.15 mole/liter or more of sulfite ion and having a pH adjusted to from 9.5 to 12.3.

23. A high contrast negative image-forming method as in claim 22, wherein a development time for said silver halide photographic material is from 15 to 60 seconds.

24. A high contrast negative image-forming method as in claim 22, wherein said developer contains a dihydroxybenzene as a main developing agent and a 3-pyrazolidone as an auxiliary developing agent.

25. A high contrast negative image-forming method as in claim 24, wherein the amount of the dihydroxybenzene is from 0.05 to 0.5 mole/liter of the developer, and the amount of the 3-pyrazolidone is 0.06 mole/liter of the developer or less.

* * * * *